United States Patent [19]

Landin

[11] Patent Number: 4,693,025

[45] Date of Patent: Sep. 15, 1987

[54] DISPLAY ELEMENT

[76] Inventors: Pedro Landin, 10807 N.W. 7th St., No. 11, Miami, Fla. 33172

[21] Appl. No.: 894,392

[22] Filed: Aug. 12, 1986

Related U.S. Application Data

[63] Continuation of Ser. No. 719,084, Apr. 2, 1985, abandoned.

[51] Int. Cl.[4] ..... G09F 3/00; G09F 19/00

[52] U.S. Cl. ..... 40/326; 40/406; 40/439; 40/477

[58] Field of Search ..... 40/326, 2 R, 406, 407, 40/408, 409, 411, 412, 421, 422, 427, 439, 446, 477, 584

[56] References Cited

U.S. PATENT DOCUMENTS

| | | | |
|---|---|---|---|
| 713,606 | 11/1902 | Cole | 40/326 |
| 2,645,486 | 7/1953 | Monahan | 40/326 |
| 3,372,501 | 3/1968 | Greene | 40/477 |
| 3,841,010 | 10/1974 | Ludwig | 40/326 |
| 4,211,024 | 7/1980 | Nickell | 40/406 |
| 4,395,835 | 8/1983 | Schneider | 40/406 |
| 4,420,897 | 12/1983 | Castleberry | 40/427 |

FOREIGN PATENT DOCUMENTS

| | | | |
|---|---|---|---|
| 28321 | 9/1931 | Australia | 40/326 |
| 1519068 | 2/1968 | France | 40/326 |

*Primary Examiner*—Gene Mancene
*Assistant Examiner*—J. Hakomaki
*Attorney, Agent, or Firm*—John Cyril Malloy

[57] ABSTRACT

A display element including a sealed housing filled with an opaque, translucent or colored transparent liquid and having a screen therein colored on its front side and movable back and forth within the housing. The housing has a front transparent panel such that, when the screen is displaced in one direction, the colored front side of the screen is visible through the transparent panel. When the screen is displaced in the other direction, the colored front side of the screen is obscured or hidden from view by the liquid, which may be white or a color different from that of the screen. In one alternate embodiment, the transparent panel of the housing includes colored message indicia therein, which color matches either the liquid color or that of the colored front side of the screen, the other color contrasting. When the screen is moved in one direction, the message indicia disappears; in the other direction, the contrasting background color makes the message indicia readily visible. In another embodiment which facilitates two different messages alternately, one message in a first color is applied to the front transparent panel which first color is also that of the background color of the screen's front surface. A second message is applied over the background of the screen's front surface in a contrasting second color which is the same as that of the liquid. When the screen is forwardly, the second message is viewable; when the screen is rearwardly, the first message is viewable. Several means for controlling the movement of the screen are disclosed as well as unique screen shapes to facilitate function. Several means for controlling the movement of the screen are disclosed. This invention may be embodied in a single element or in a plurality of elements incorporated into a matrix and individually controlled to form desired message.

8 Claims, 16 Drawing Figures

DISPLAY ELEMENT

This application is a continuation of Ser. No. 719,084, filed Apr. 2, 1985, now abandoned.

BACKGROUND OF THE INVENTION

This invention relates generally to means for displaying a message, and more particularly, to the structural components of a display element.

In the past, several means for displaying a predetermined commercial or informational, viewable message were available. One such means included a matrix of lightable, incandescent bulbs to form the desired message. Such equipment consumes excess electric power and is susceptible to bulb failure. A second type of display means is that of a magnetically operated disc-shaped display element oppositely colored on opposite sides, pivotally mounted and including magnet means for controlling disc orientation. Such devices are disclosed in U.S. Pat. Nos. 3,140,553; 3,283,427; 3,295,238; 3,365,284; 3,303,494; 3,624,941; and 3,996,680. This type of display element is prone to misalignment and other environmentally-caused problems and deterioration.

Another type of display element is that of back-lighted openable holes in a matrix formt. However, in addition to consuming excess electric power, the aperture-closing means are complex, subject environmentally-induced problems which may also deteriorate inter-electrical components. Cleaning is also a major problem with all of the above devices.

The present invention is that of a sealed, highly reliable, and simple, passive-like display element which consumes low levels of electric power and is easily servicable and cleanable. There may be a plurality of small such display elements arranged in matrix form and preprogrammed and controlled to collectively form messages, or only a larger single element may be used to display a single message or dual messages repeatedly or continuously.

BRIEF SUMMARY OF THE INVENTION

The present invention is that of a display element which includes a screen having a colored surface and held for flotation-type free-floating or diaphragm-type controlled movement within opaque, translucent, or colored transparent liquid, all within a housing. The housing includes a front transparent panel which aligns with the colored screen surface. Several means are provided for translating the screen back and forth within the housing from a forwardly position wherein the colored screen's surface is visible to a rearwardly position wherein the screen is displaced away from the transparent front panel. In this rearwardly position, the liquid, having a different and contrasting color from that of the screen, obscures visibility of the colored screen, in which case, the color of the liquid is visible. The liquid may also serve as background for contrasting-colored message indicia, which may be applied to the surface of the transparent front panel. By proper color selection, dual alternating messages are also possible.

It is therefore an object of this invention to provide a novel display element which is permanently sealed and immune to weather deterioration.

It is another object of this invention to provide a movel display element which may either be incorporated in plurality into a matrix structure for selectively combining to display any desired message, or may be singularly utilized in different sizes and shapes to display a predetermined message repeatedly or continuously.

It is yet another object of this invention to provide a novel dual-message display element which will alternately display each message.

It is still another object of this invention to provide a novel display element which is easily cleaned and has high reliability.

In accordance with these and other objects which will become apparent hereinafter, the instant invention will now be described with reference to the accompanying drawings in which:

DETAILED DESCRIPTION OF THE PREFERRED EMBODIMENT

Figure 1:
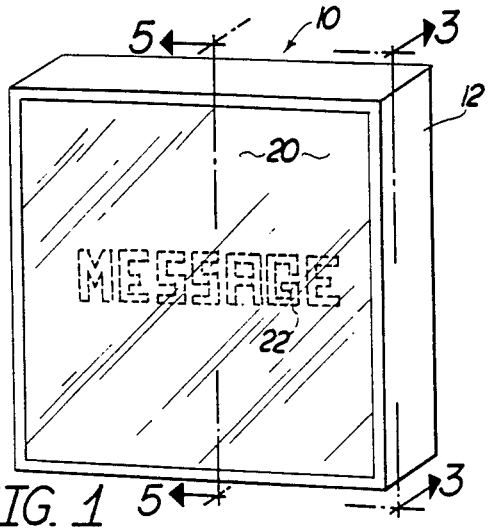
FIG. 1 is a perspective view of the invention.

Referring now to the drawings, and particularly to FIG. 1, the preferred embodiment of the invention is shown generally at 10 and includes a generally rectangular housing 12 having a transparent front panel 20. Note that any other convenient or desired front elevation shape (not shown) could be employed. Alternately, this transparent panel 20 may also include a display message 22 (shown in dotted lines) whose purpose and function will become clear herebelow.

Figure 2:
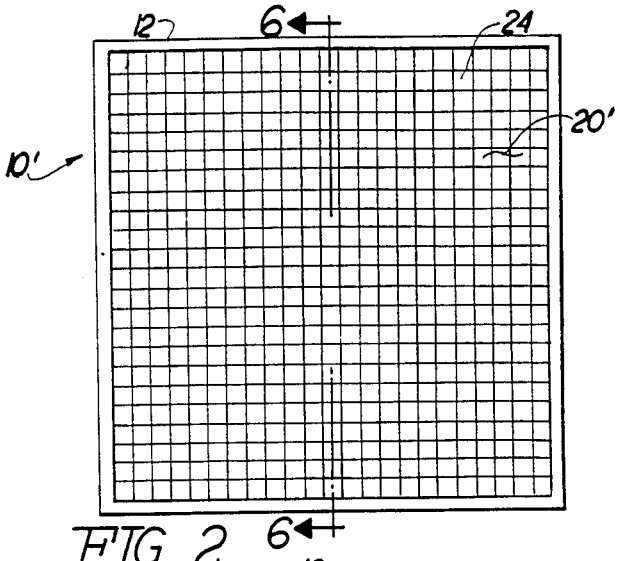
FIG. 2 is a front elevation view of an alternate embodiment of the invention.

Referring to FIG. 2, a first alternate embodiment is shown generally at 10', and includes the same generally rectangular housing 12, but having a diamond pattern front panel 20' which has an even distribution of uniform reflective geometric shapes 24 thereover. These geometric shapes 24 serve to enhance the distinctive appearance of the display element 10'.

Figure 3:
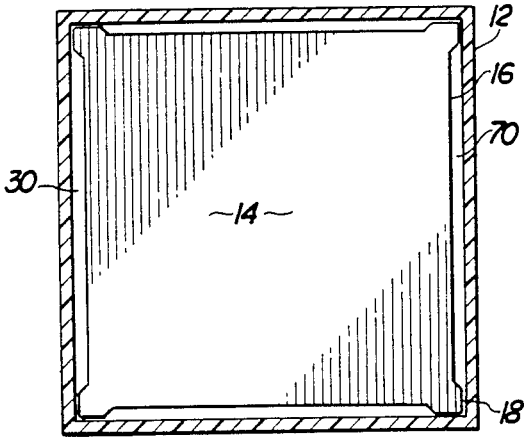
FIG. 3 is a section view in the direction of arrows 3—3 in FIG. 1.

In FIG. 3 is seen a thin inner screen 14 of relatively rigid sheet material which fits within the housing 12, supported and aligned at corner portions 18 for ease in front-to-back translation within the housing 12 by means to be described herebelow. The housing 12 is filled with an opaque liquid 30 which flows from one side of the screen 14 through slots 70 formed by edge recesses 16, flow occurring to facilitate movement of the screen 14 within the housing 12. Alternately, the screen may be perforated to facilitate fluid flow (not shown).

Figure 5:
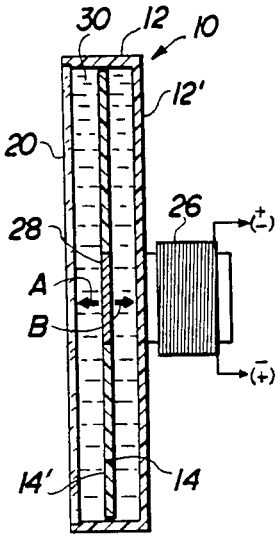
FIG. 5 is a section view in the direction of arrows 5—5 in FIG. 1.

Referring now to FIGS. 5 through 8, four alternate embodiments of the means for translating the screen within the housing are shown. In FIG. 5, the screen 14 is free-floating within the opaque liquid 30 and includes a colored front surface 14' which is contrasting in color to that of the opaque liquid 30. An electro-magnet 26 is connected to the outside surface of the back panel 12' of the housing 12 and wired to suitable controlled voltage. Note that the electro-magnet 26 could also be mounted within the housing 12 to the inside surface of the back panel 12'. Embedded within the screen 14 is a permanent magnet 28. The electro-magnet 26 may attract the permanent magnet 28 and connected screen 14 to the back panel 12' in the direction of arrow B, and, in this screen 14 position, only the opaque liquid 30 is visble through the transparent front panel 20. However, when the electro-magnet 26 forces the screen 14 in the direction of arrow A against the transparent panel 20, the colored surface 14' of the screen 14 is visible.

Figure 6:
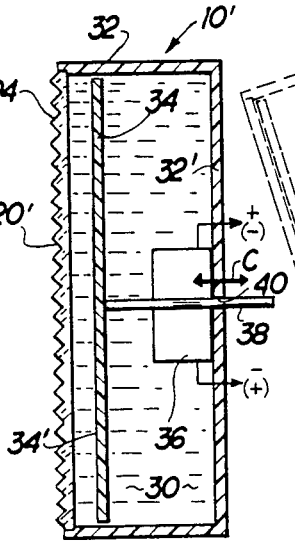
FIG. 6 is a section view in the direction of arrows 6—6 in FIG. 2.

In FIG. 6, connected to the inside back surface 32' of the housing 32 is an electric solenoid 36, having an output shaft 38 which translates back and forth in the direction of arrow C by alternating the d.c. voltage polarity applied thereto. The output shaft 38 passes through liquid seal 40 in the back panel 32' of housing 32 and is connected to the back surface of screen 34. Thus, as the output shaft 38 moves, so moves the screen 34, having the same visual effect as described above regarding FIG. 5, except that the front transparent panel 20' includes an even distribution of geometric reflective shapes 24 to enhance the distinctive visual effect as described above in reference to FIG. 2.

Figure 7:
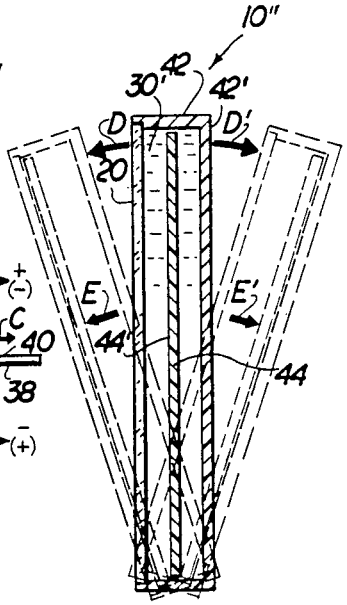
FIG. 7 is a vertical centerline section view through another embodiment of the invention.

In FIG. 7, simply by tilting the housing 42 in the direction of arrow D or D', the screen 44 will move in the direction of arrows E or E', respectively, within translucent liquid 30'. Alternately, the screen 44 may rest into a groove (not shown) along the lower inside surface of the housing 42 such that the screen 44 merely pivots along its lower margin back and forth as the housing is tilted. Liquid translucency produces a still different alternating visual display effect as subtle amounts of screen front surface 44' color filter through the transparent front panel 20 even when the screen 44 is displaced in the direction of arrow E' against the housing back panel 42'.

Figure 8:
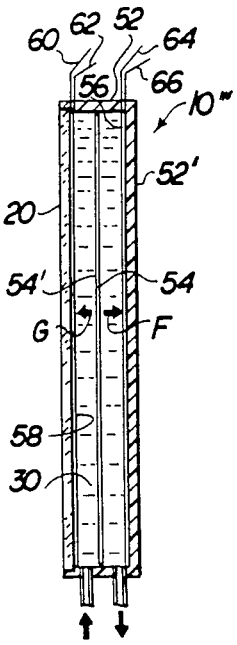
FIG. 8 is a vertical centerline section view through still another embodiment of the invention.

Another alternate means for moving the screen 54 back and forth in housing 52 is shown in FIG. 8, which operates by the principle of electro-static mesh panels 56 and 58. Suitable electrical voltage is applied across the mesh panels 56 and 58 via electrical leads 60, 62, 64, and 66 to cause the voltage polarity-sensitive screen 54 to move in either direction F or G within the opaque liquid 30. As previously discussed, visible through transparent panel 20 is either the opaque liquid 30 when the screen 54 is displaced in the direction of arrow F, or the contrasting colored front screen surface 54', when the screen 54 is displaced in the direction of arrow G.

Referring back now to FIGS. 1 and 5, the transparent front panel 20 may include a display message 22 thereon, either on inside or outside surface, of the same color as that of the opaque liquid 30. When the contrasting-colored screen front surface 14' is displaced in the direction of arrow B, the message 22 disappears in the background of the opaque liquid 30. However, when displaced in the direction of arrow A, the opaque liquid 30 is forced from between the transparent front panel 20 and screen 14, the colored front screen surface 14' becomes visible as does the contrasting-colored message 22.

To achieve dual alternating messages, a first message 22 is applied in a first color which matches the background color of the front surface 14' of the screen 14. A second message, which does not align with any portion of the first message 22, is applied over the background color of the front surface 14'. The liquid color matches that of this second message. When the screen 14 is forwardly in the direction of arrow A, the second message is viewable, the screen's background color hiding the first message. When the screen 14 is rearwardly in the direction of arrow B, the first message is viewable, the liquid hiding the second message.

Figure 4:
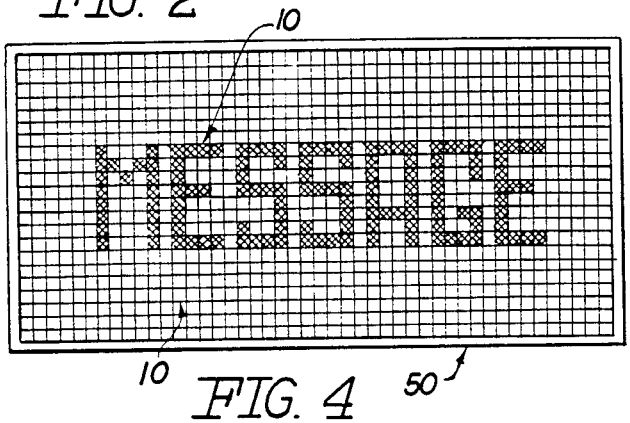
FIG. 4 is a front elevation view of a display matrix comprising a plurality of the invention arranged in columns and rows one to another.

Referring again to FIG. 4, each element within the matrix 50 is one unit of display element 10, which elements are shown with their screens 14 displaced forward in the direction of arrow A in FIG. 5 and appear dark, which while the remainder of the display elements 10 have their screens 14 displaced rearward in the direction of arrow B and appear light, the color of the opaque liquid 30. Employing conventional electronic program control means, the display elements 10 are selectively so actuated to form any desired message.

Figure 9:
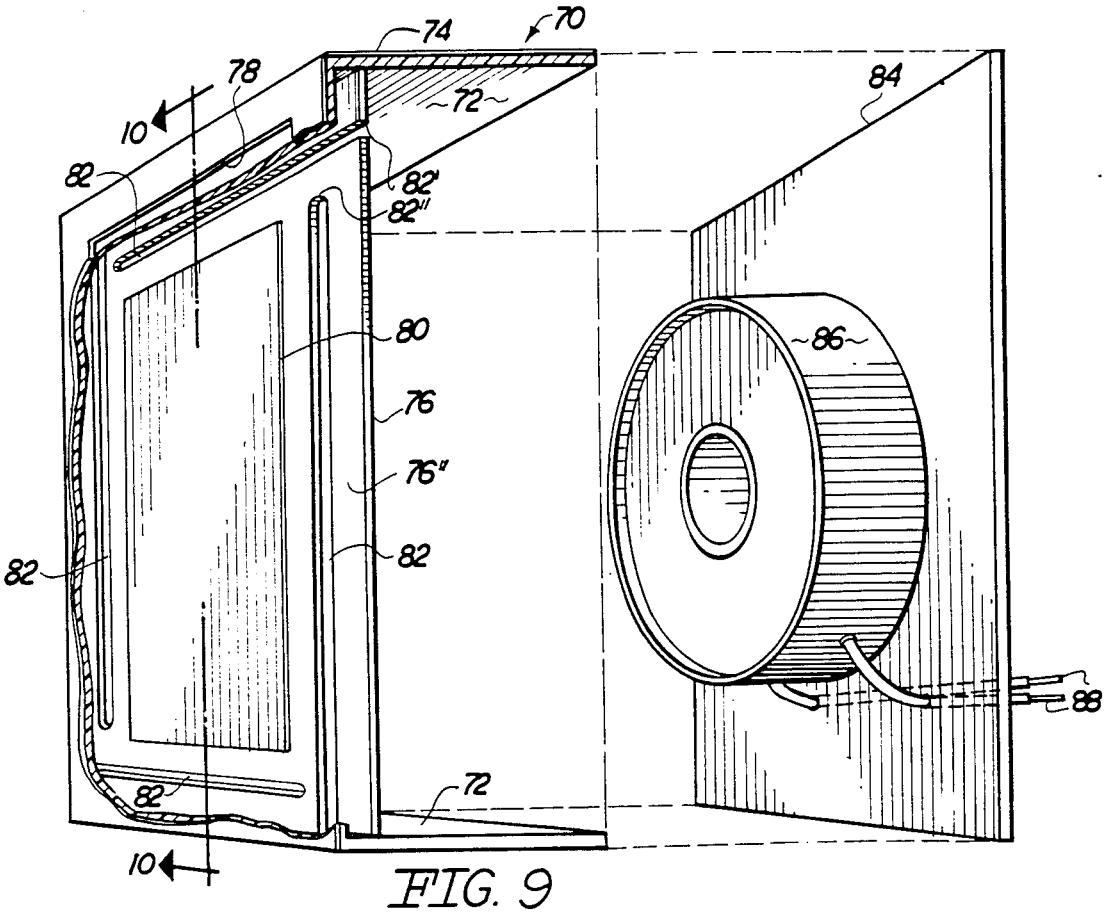
FIG. 9 is an exploded perspective view of yet another embodiment of the invention.
Figure 10:
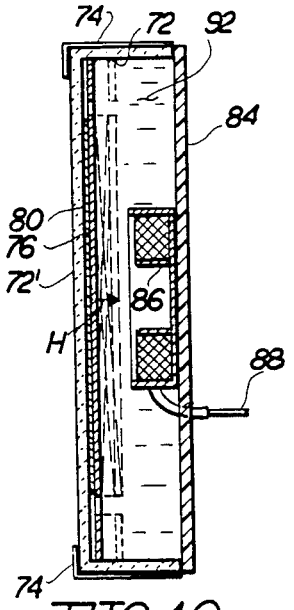
FIG. 10 is a section view through arrows 10—10 in FIG. 9.
Figure 11:
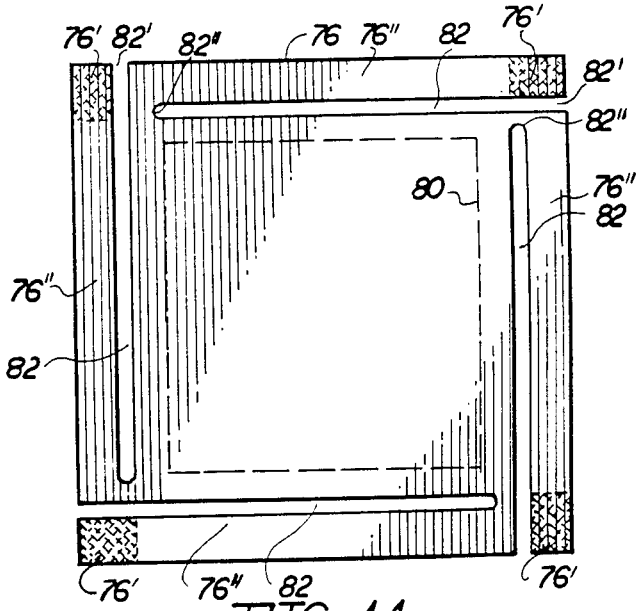
FIG. 11 is a front elevation view of the screen included in the embodiment shown in FIG. 9.

Referring now to FIGS. 9, 10, and 11, another embodiment of the invention is shown generally at 70 and includes a housing 72 fabricated of clear, molded plastic material. Applied around the edges of the housing is an opaque film 74, which restricts viewing of the screen 76 to the front transparent panel 78. The screen 76 is fabricated of thin, relatively rigid, yet flexible material and includes a plurality of slits 82, each slit 82 generally running adjacent a marginal portion or length of the margin of the screen 76. Each slit 82 transects or exits a margin at one end 82' and terminates at the opposite end 82'' in close proximity to the next adjacent slit 82. This arrangement of slits 82 continues substantially along the entire margin or peremeter of the screen 76, forming the marginal portions or tangs 76''. The screen is adhered against the inside surface of the front panel opening 78 at adhesion patches serving as connecting portions 76' as best seen in FIG. 11. These adhesion patches 76' are located at the free ends of the tangs 76'' as shown. The screen 76 may include message indicia film 80 applied to the front surface of the screen 76 or the screen 76 may be color-coded to contrast with opaque-colored liquid.

However, either the screen 76, or the message indicia film 80, or both, must be magnetic to affect the following function. As best seen in FIG. 10, when electro-magnet 86 is energized by appropriate electrical current through leads 88, the magnetic screen 76 is attracted rearwardly in the direction of arrow H toward the coil 86. As may now be understood, the above-described slits forming tangs 76'' facilitate this rearward movement, primarily of the mid-section of the screen, somewhat in diaphragm-type fashion. The center of the screen may be colored or include message indicia film 80. These tangs 76'' which, at one end 76' are adhered to the front panel as previously described, act in unison in cantilever-fashion with sufficient spring bias to return the center portion 80 of the screen forwardly and flatly against the front panel 72' when the coil 86 is de-energized. When the coil 86 has been energized, the center section 80 of screen 76 is displaced rearwardly sufficiently to allowo a layer of opaque liquid 92, which fills the housing 72, to flow between the front transparent panel 72' and the screen 76 to obliterate from view the message indicia film 80. Note here that although a generally square front elevation shape for this embodiment 70 is preferred, virtually any planar shape could be utilized.

Figure 12:
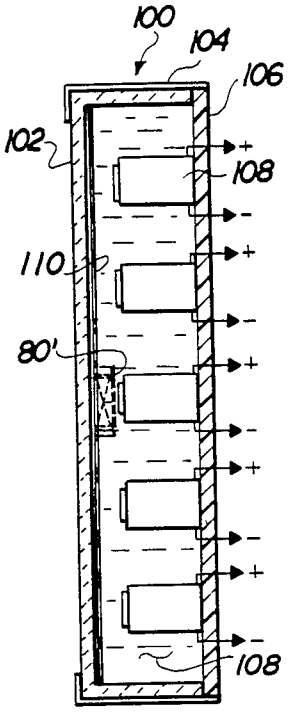
FIG. 12 is a vertical centerline section view through still another embodiment of the invention.
Figure 13:
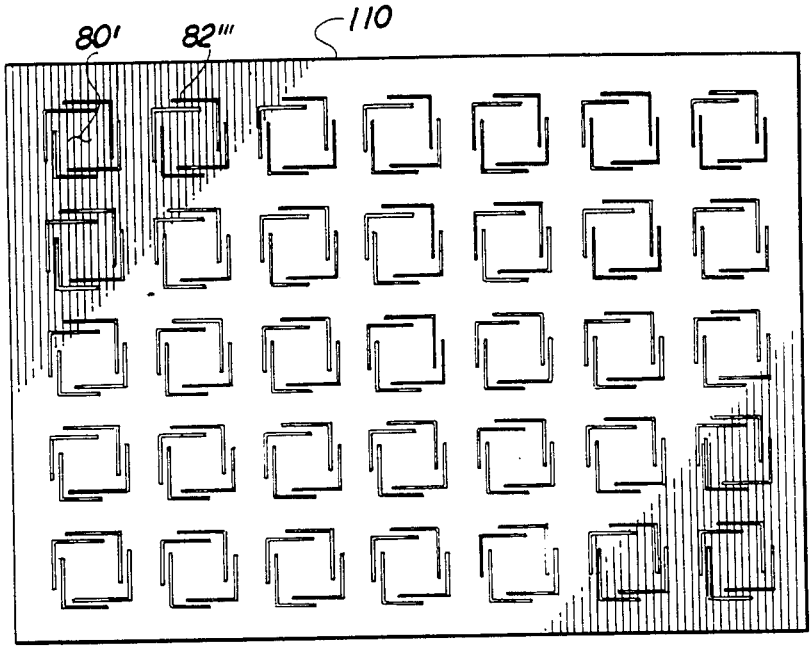
FIG. 13 is a front elevation view of the screen included in the embodiment shown in FIG. 12.

Referring now to FIGS. 12 and 13, another embodiment of the invention is shown generally at 100 and includes formed into a single thin, relatively rigid, yet flexible screen sheet 110, a plurality of mid-sections 80', formed by slits 82''' in a manner and orientation similar to that previously described. This screen sheet 110 is connected at or adjacent its margins within housing 104 such that, as previously described, the entire screen sheet 110 is against the inside surface of the front transparent panel 102. Housing 104, as before, is transparent and is opaquely coated around its edges to allow viewing of the screen only through the transparent front panel 102. Back panel 106 seals the liquid within the housing 104. By selectively activating particular electro-magnet coils 108, which are connected to the inside surface of the rear panel 106, the screen mid-sections 80' are drawn rearwardly as shown in FIG. 12. Thusly, liquid 108 is sufficiently thickly layered between the screen mid-section 80' and the transparent front panel to obscure viewing of the colored front surface or message indicia thereon.

Figure 14:
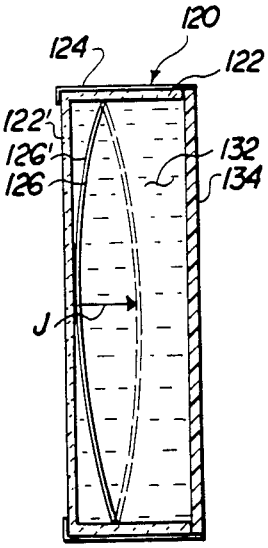
FIG. 14 is a vertical centerline section view through yet another embodiment of the invention.
Figure 15:
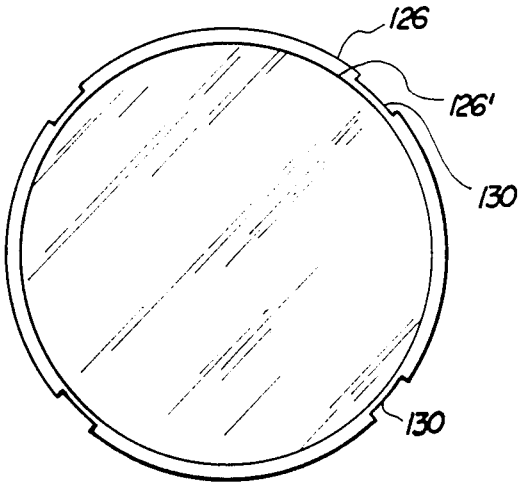
FIG. 15 is a front elevation view of the screen included in the embodiment shown in FIG. 14.

In FIGS. 14 and 15, still another embodiment is shown generally at 120 and includes a diaphragm-type screen held within a housing 122 having colored liquid 132, all sealed therein by back panel 134. The diaphragm screen 126 is fabricated of thin bimetallic, relatively rigid yet flexible material. At a particular liquid 132 temperature, the diaphragm screen 126 assumes the cross-section shape as shown in solid lines in FIG. 114, and the front surface 126' is viewable through transparent front panel 122'. At another particular liquid 132 temperature, the diaphragm screen 126 assumes the shape shown in dotted lines, wherein the transparent liquid 132 obscures viewing of the message indicia for colored front surface 126'. Recesses 130 facilitate liquid flow from one side of the diaphragm screen 126 to the other.

Figure 16:
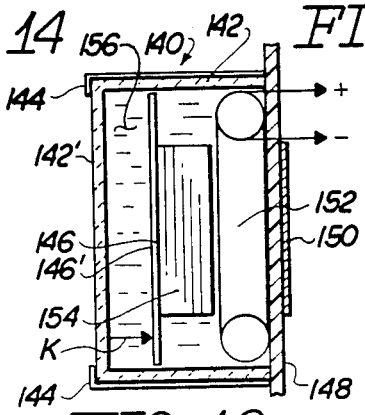
FIG. 16 is a vertical centerline section view through still another embodiment of the invention.

Referring lastly to FIG. 16, still another embodiment of the invention shown generally at 140 and includes a transparent plastic housing 142 having opaque coating 144 around its edges as previously described. A thin, rigid screen 146, having a permanent magnet 154 connected to the back surface of the screen 146, is positioned for floating forward and backward translation while emersed in colored liquid 156, all sealed within the housing 142 by plastic back panel 148. Electro-magnet coil 152 is mounted against the inside surface of the back panel 148. The permanent magnet 154 and coil 152 are adapted to repel one another when the coil is properly electrically energized. Thus, the screen 146, having message indicia applied to the front surface 146', is forced against the front transparent panel 142', and a message indicia is viewable. When the coil 152 is de-energized, a thin magnetic plate, adhered or integral to, the back panel 148, attracts the permanent magnet 154, and thus displaces the screen rearwardly in the direction of arrow K, obscuring vision of the message indicia.

Without limiting the full scope of, and claims to, this invention in any manner, it should be recognized that, when the screen is moved rearwardly from the front transparent panel as little as 1/16 of an inch, allowing colored liquid to fill this gap, at least two optical affects are possible. First, if the color of the liquid is not transparent, the liquid will reflect light, completely obscuring vision of the contrasting screen color or message indicia. Second, if the colored liquid is transparent, it will act as a filter, letting the partially obscured screen surface reflect light. A white screen surface will cause the liquid color to be seen. A different color screen will result in a combination or blend of screen and liquid colors being seen.

In geographic or situational areas of use where ambient temperature drops below the liquid's normal freezing temperature, an anti-freeze may be added.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A display element comprising:

(a) a sealed housing having a transparent front panel and a back panel disposed in spaced relation to said front panel, (b) a diaphragm-type screen fabricated of thin, pliable material and having a front surface thereof formed of a first particular color and a back surface, (c) said diaphragm-type screen further comprising a plurality of connecting portions disposed about the margin of said diaphragm-type screen, said connecting portions structured for fixed attachment to an inside portion of said housing, (d) said diaphragm-type screen further including a mid-portion on which said front surface is formed, and a plurality of marginal portions each formed of pliable material and integrally interconnected between respective ones of said connecting portions and said mid-portion and structured to be movable within said housing for selective positioning of said mid-portion relative to said housing front panel, (e) said mid-portion and front surface thereon selectively positionable between an aligned, registered and viewable position relative to said housing front panel whereby said front surface is viewable through said housing front panel, (f) said mid-portion and front surface selectively movable rearwardly from said housing front panel into a non-viewable position, said marginal portions structured for interconnection and restricted placement of said mid-portion and front surface while maintaining interconnection thereof between said connecting portions and said mid-portion of said diaphragm-type screen, (g) a volume of liquid substantially filling said housing with said diaphragm-type screen therein and having a second particular color which contrasts with said first particular color of said front surface of said diaphragm-type screen, (h) a plurality of elongated slits each extending along a majority of a different marginal portion and formed contiguous thereto, each slit disposed between the respective marginal portion and said mid-portion, (i) said marginal portions and said slits being cooperatively disposed to define a movable attachment of said mid-portion of said screen to said connecting portions; said slits disposed and dimensioned to allow passage therethrough of a portion of said volume of liquid, said volume of liquid disposed in part on both sides of said diaphragm-type screen as it moves toward and away from said front panel of said housing, and (j) displacing means for moving said mid-portion of said diaphragm-type screen relative to said housing front panel being mounted on said housing in communication relation to said back surface of said diaphragm-type screen.

2. A display element as set forth in claim 1, wherein:

said diaphragm-type screen material is bimetallic;

said means for said displacing said mid-portion of said diaphragm-type screen in variable temperature liquid.

3. A display element as set forth in claim 1, wherein: said volume of liquid is freeze-resistant at relatively low ambient temperatures.

4. A display element as in claim 1 wherein each connecting portion is formed on a free end of one of said marginal portions and is structured for fixed attachment to an inside portion of said housing.

5. A display element as in claim 4 wherein each of said connecting portions comprise an adhesion patch fixedly securable on an inside portion of said housing.

6. A display element as in claim 1 wherein each connecting portion is formed on a free end of one of said marginal portions and is structured for fixed attachment to an inside portion of said housing.

7. A display element as in claim 6 wherein each of said connecting portions comprise an adhesion patch fixedly secured to an inside of said housing.

8. A display element as in claim 1 wherein said diaphragm-type screen is formed at least in part of magnetic material; said displacing means comprising an electromagnetic assembly mounted in spaced and communicating relation to said mid-portion and selectively chargable, whereby said mid-portion is selectively movable relative to said front panel of said housing.

* * * * *